US010449104B2

(12) United States Patent
Jamesapollos

(10) Patent No.: US 10,449,104 B2
(45) Date of Patent: Oct. 22, 2019

(54) STRETCHING DEVICE TO RESTORE AND PROTECT AGAINST THE NEGATIVE EFFECTS OF PROLONGED SITTING

(71) Applicant: The Well Effect Company, Bedford, MA (US)

(72) Inventor: John Jamesapollos, Bedford, MA (US)

(73) Assignee: The Well Effect Company, Bedford, MA (US)

( * ) Notice: Subject to any disclaimer, the term of this patent is extended or adjusted under 35 U.S.C. 154(b) by 58 days.

(21) Appl. No.: 15/703,231

(22) Filed: Sep. 13, 2017

(65) Prior Publication Data

US 2019/0076315 A1 Mar. 14, 2019

(51) Int. Cl.
*A63B 23/035* (2006.01)
*A63B 23/04* (2006.01)
(Continued)

(52) U.S. Cl.
CPC ..... *A61H 1/0244* (2013.01); *A63B 23/0216* (2013.01); *A63B 23/0233* (2013.01);
(Continued)

(58) Field of Classification Search
CPC ..... A61H 1/0244; A61H 2201/165; A61H 2201/1642; A61H 2201/164;
(Continued)

(56) References Cited

U.S. PATENT DOCUMENTS 2,777,439 A * 1/1957 Tuttle ..... A61H 1/02 482/118
3,724,450 A * 4/1973 Chaitin ..... A61H 1/02 482/131
(Continued)

FOREIGN PATENT DOCUMENTS

CA 2172085 9/1997
CN 203154719 8/2013
(Continued)

OTHER PUBLICATIONS

EZ-Up Inversion & Chin Up System; http://teeter.com/EZ-UP-Inversion-Chin-Up-System.html#WQDcL00rJ8w.
(Continued)

*Primary Examiner* — Andrew S Lo
(74) *Attorney, Agent, or Firm* — McInnes & McLane LLP; Seth Abraham Milman

(57) ABSTRACT

The stretching device and methods disclosed herein allow an individual to create and sustain a differential stretch to the anterior muscles and ligaments of the torso, hips and legs. The device includes a base frame, a vertical member secured to the base frame, a rotational lift lever secured to the vertical member at a vertical pivot member, a lower extremity elevation member secured to the rotational lift member, and at least one lower extremity attachment device secured to the lower extremity elevation member. In methods of use, the device is used to create an anterior stretch by lifting an individual's leg or legs off of the ground, while the person is prone, so as to create a stretch in the anterior muscles, fascia, or ligaments. The device has various planes of rotation, and is adjustable in height as well as transverse displacement along the base to accommodate different body types.

4 Claims, 3 Drawing Sheets

(51) Int. Cl.
*A63B 23/00* (2006.01)
*A61H 1/02* (2006.01)
*A63B 23/02* (2006.01)

(52) U.S. Cl.
CPC ..... *A63B 23/03525* (2013.01); *A63B 23/04* (2013.01); *A61H 2201/165* (2013.01); *A61H 2201/1642* (2013.01); *A63B 2023/006* (2013.01)

(58) Field of Classification Search
CPC ..... A61H 1/0266; A61H 2201/1628; A61H 2201/1676; A61H 2201/1652; A61H 1/0237; A63B 23/04; A63B 23/0216; A63B 23/03525; A63B 23/0233; A63B 2023/00; A63B 21/4011; A63B 21/4013; A63B 21/4015
See application file for complete search history.

(56) References Cited

U.S. PATENT DOCUMENTS 4,232,662 A * 11/1980 Barber ..... A61H 1/0218 482/144
4,478,213 A * 10/1984 Redding ..... A61H 1/0214 601/26
5,203,755 A * 4/1993 Kaiser ..... A61H 1/0218 482/142
5,318,495 A * 6/1994 Malynowsky ..... A63B 21/023 482/129
5,449,336 A * 9/1995 Sabel ..... A61H 1/0218 482/130
6,261,250 B1 * 7/2001 Phillips ..... A63B 21/0058 482/121
6,468,192 B1 10/2002 Doerscheln
7,322,911 B2 1/2008 Webber
8,784,284 B1 * 7/2014 Smith ..... A63B 21/1609 482/121
9,089,468 B2 7/2015 Wang
2002/0016240 A1 * 2/2002 Conner ..... A63B 21/0552 482/125
2002/0183176 A1 * 12/2002 Read ..... A63B 22/0007 482/148
2005/0049124 A1 * 3/2005 Xieh ..... A63B 22/16 482/142
2005/0130814 A1 * 6/2005 Nitta ..... A63B 1/00 482/121
2005/0181917 A1 8/2005 Dayal
2008/0182730 A1 * 7/2008 Conley ..... A61H 1/0244 482/95
2009/0258767 A1 * 10/2009 Foucault ..... A63B 21/0087 482/111
2009/0325768 A1 * 12/2009 Wessels ..... A63B 21/0004 482/105
2010/0216616 A1 * 8/2010 Jennings ..... A63B 21/015 482/142
2010/0279832 A1 * 11/2010 Conley ..... A61H 1/0244 482/131
2013/0225378 A1 * 8/2013 Burek ..... A63B 26/00 482/142
2015/0314157 A1 * 11/2015 Lampert ..... A63B 23/035 482/3
2016/0228736 A1 8/2016 Cuttino
2017/0014666 A1 * 1/2017 Sather ..... A63B 23/0205
2017/0189748 A1 * 7/2017 Montgomery ..... A63B 23/0494
2018/0021614 A1 * 1/2018 Taft ..... A63B 24/0087 482/5

FOREIGN PATENT DOCUMENTS

GB 2271292 4/1994
WO WO 2013102250 7/2013

OTHER PUBLICATIONS

Ironman LX300 5502 Inversion Table; https://paradigmhw.com/product/ironman-lx300-inversion-table/.
Powerline Glute Max; www.bodysolid.com/home/pgm200x/powerline_glute_max.

* cited by examiner

STRETCHING DEVICE TO RESTORE AND PROTECT AGAINST THE NEGATIVE EFFECTS OF PROLONGED SITTING

FIELD

The present invention relates to a device for re-balancing the body after prolonged or repetitive sitting or to use to prevent the unbalancing of the body in anticipation of prolonged sitting. More specifically, the present invention is directed toward a mechanism for differentially stretching the tighter, shorter anterior muscles and ligaments of a person's torso, while simultaneously not overstretching the longer, weaker posterior muscles and ligaments.

BACKGROUND

A common deleterious effect from prolonged or repetitive sitting is the differential effect on the person's body with respect to anterior and posterior muscles and ligaments. It is well understood that prolonged or repetitive sitting leads to tighter, shorter anterior muscles and ligaments in a person's body and a concomitant, but opposite, effect on the posterior muscles and ligaments, which are lengthened and weakened. Other activities of a repetitive or prolonged nature can cause a similar deleterious effect on a person's body because as muscles and ligaments around joints become imbalanced, posture and movement become affected leading to knee, hip, back, neck and shoulder pain. The most common causes of movement dysfunction and pain are the muscular and ligamentous imbalance and subsequent joint irritation that proceeds from these imbalances.

Numerous methods and treatments have been devised to treat muscle and joint pain. For example, U.S. Pat. No. 6,468,192 entitled "Frame for Body Stretching Exercises" describes a frame for stretching the upper and lower body as well as the abdominal muscles. See '192 patent Col. 3:43-4:5. The '192 patent is directed toward pre-exercise stretching as a means of avoiding injury and general stretching to enhance health. Id. at Col. 1:10-21.

Similarly, U.S. Patent Publication No. 2005/0181917 entitled "Back Traction and Muscle Stretching Bench," describes an angled bench having a leg attachment, which is used to place an individual's back in traction. The force of the traction applied to the user's spine can be varied. The goal of the '917 patent publication is to provide a variety of traction, stretching, and exercise solutions for treating and preventing pain in the lumbar region. See '917 patent publication at ¶0001.

In addition, international patent publication number WO 2013/102250 entitled "Gravity Assisted Spine Decompression Apparatus," discloses a device "designed to relax the user's back muscles as gravity safely and smoothly decompresses his/her thoracic and lumbar vertebrae while lying chest side on the apparatus; and same said apparatus being made reconfigurable to safely and smoothly decompress the user's cervical vertebrae while lying back side on the apparatus." See Abstract of '250 patent publication.

While each of these devices claim to provide relief for back pain, or aid in the stretching of abdominal or back muscles, each of these devices is designed to principally stretch the posterior muscles and ligaments of the body. None of these devices stretches the anterior muscles and ligaments, which is problematic because, the more we sit, the shorter the anterior muscles and ligaments become. It is therefore desirable to have a device that can stretch and elongate the anterior muscles and ligaments that become tight and protect the lax, weaker and longer posterior muscles that result from prolonged periods of sitting.

SUMMARY OF THE INVENTION

The inventive device and methods disclosed herein allow an individual to create and sustain a differential stretch to the anterior muscles and ligaments of the torso, hips and legs. The anterior muscles in these regions tend to be tighter and shorter in individuals who sit for more than brief intervals of time. The device is comprised of a base frame, a vertical member secured to the base frame, a rotational lift lever secured to the vertical member at a vertical pivot member, a lower extremity elevation member secured to the rotational lift member, and at least one lower extremity attachment device secured to the lower extremity elevation member.

In methods of use, the device is used to lift an individual's legs off of the ground, while the person is lying face down, so as to create a stretch in the anterior muscles, fascia, or ligaments. The device has various planes of rotation, which allows for differential stretching in the various quadrants of the person's torso. In addition, the device is adjustable in height as well as displacement along a track within the base to accommodate different body types.

DETAILED DESCRIPTION

In physical therapy, a McKenzie approach uses press-up into extension whereby the person uses his or her arms to create a stretch to the anterior muscles and ligaments. While the McKenzie approach is quite effective, it does have several limitations. First, many people are unable to maintain a lack of tension in the body. Rather, the natural tendency is to use muscle tension to guard against the stretch, which essentially negates any positive stretching effect. In addition, many people's arms experience fatigue when attempting the MacKenzie approach. This fatigue prevents sustained engagement of the stretching. The present device facilitates passive stretching and solves these problems.

Figure 1:
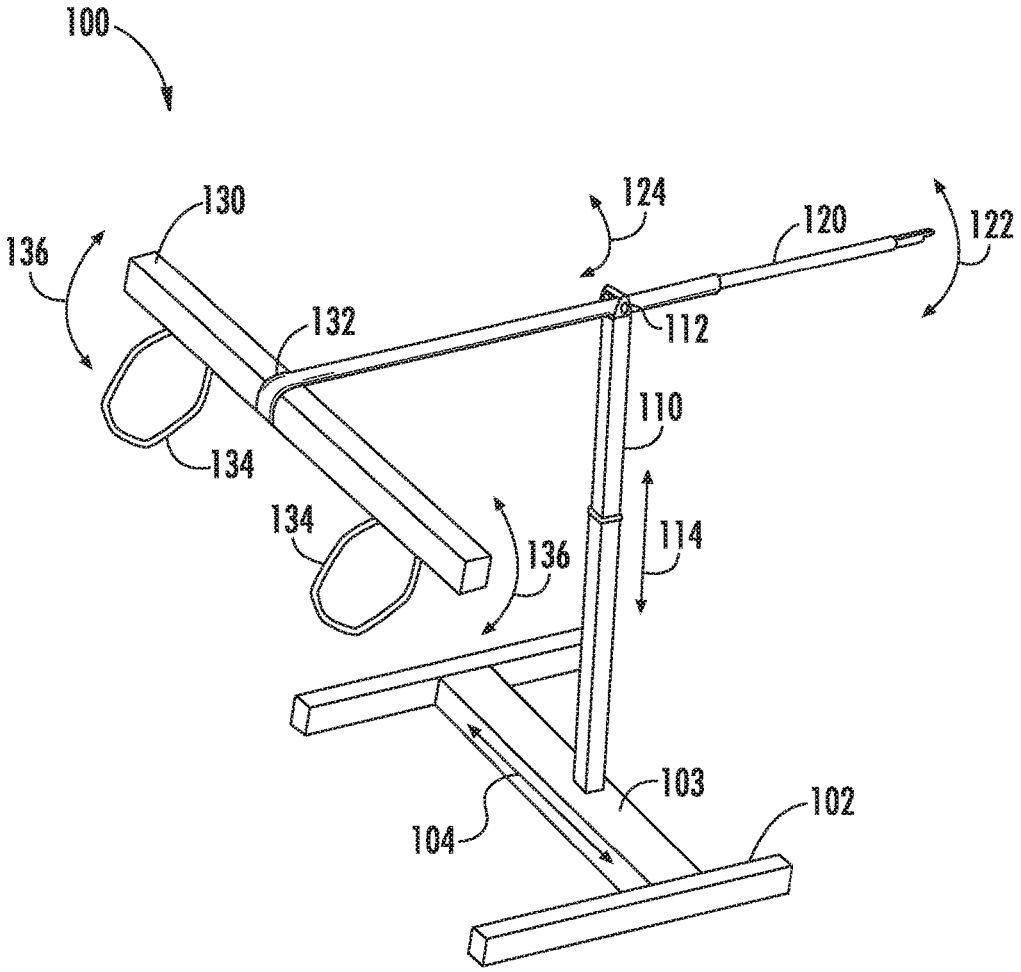
FIG. 1 is a side view of a device used to stretch at least one anterior muscle or ligament.

FIG. 1 depicts the stretching device 100 described in various embodiments herein. The stretching device 100 is comprised of a base frame which may have a transverse support member 103 and a pair of stabilizing members 102 extending rearwardly and forwardly from ends of the transverse support member 103. The base frame may have a front and a rear end, a vertical member 110 secured to the base frame, a rotational lift lever 120 secured to the vertical member 110 at a vertical pivot member 112, a lower extremity elevation member 130 secured to the rotational lift member 120, and at least one lower extremity attachment device 134 secured to the lower extremity elevation member 130. In one embodiment, the vertical member 110 is secured directly to the transverse support member 102 of the base frame.

In embodiments of the device 100, the vertical member 110 can be adjustable in height so as to accommodate different heights and weights of individuals using the device 100. A change in height of the vertical member 110 is shown in FIG. 1 along a vertical axis 114.

Along those same lines, it may be advantageous to be able to move the vertical member 110 along a transverse axis 104 of the transverse support member 102 of the base frame. In some embodiments, this could be done to alter the force required to lift an individual's feet, for example, off of the ground.

Figure 2:
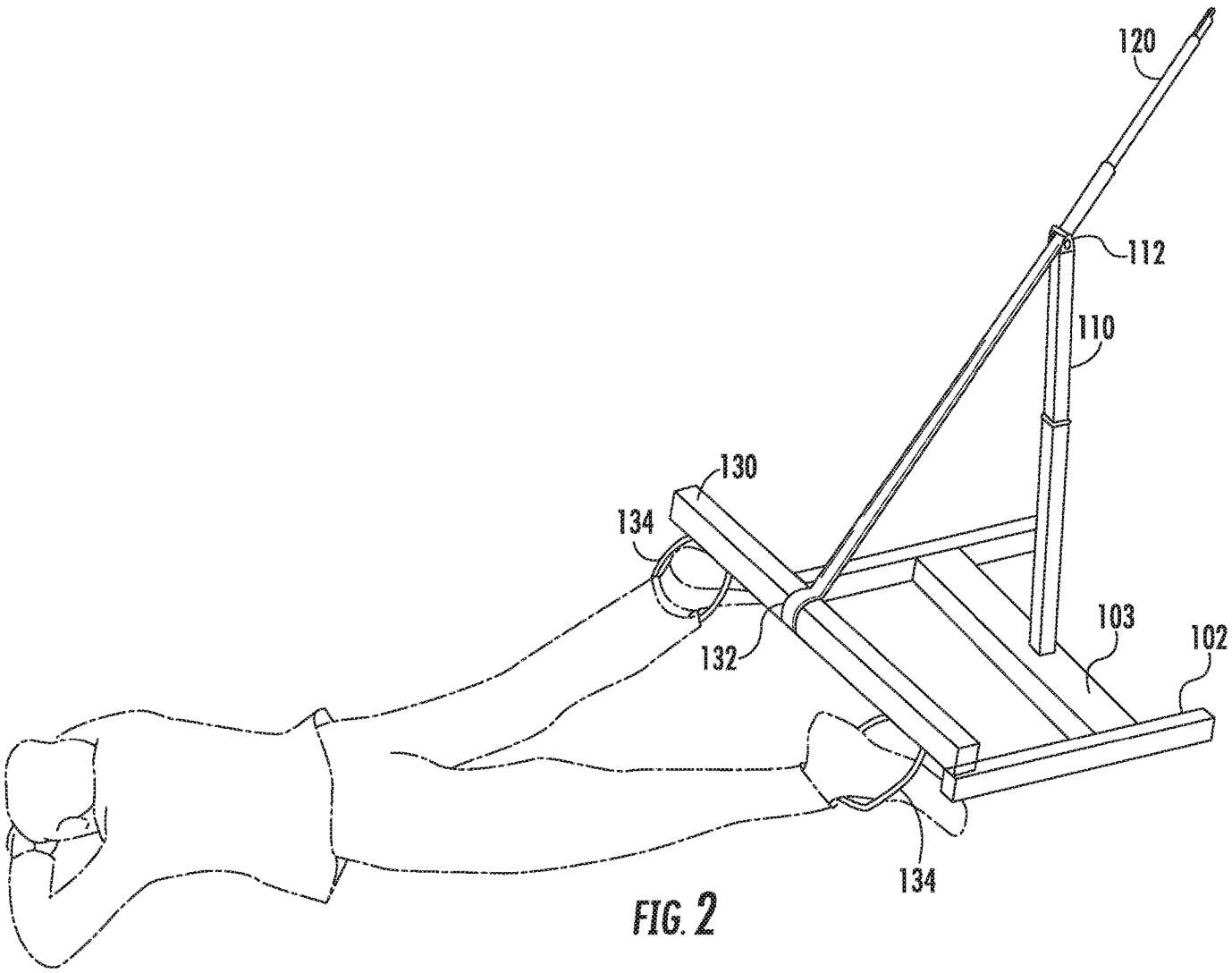
FIG. 2 is a side view of a person lying in a prone position prior to using the device for stretching at least one anterior muscle or ligament.

Referring to FIG. 2, there is shown an individual using the device 100. According to methods of use disclosed herein, and for purposes of illustration regarding the functions of the elements of the device, FIG. 2 shows an individual in a prone position prior to stretching his/her anterior muscles. In order to obtain the stretching benefits of the device, the individual places his/her feet into the lower extremity attachment devices 134. Once his/her feet are secured within the lower extremity attachment devices 134, the rotational lift member 120 can be lowered along a vertical axis 122 so as to increase the height of the lower extremity elevation member 130 with respect to the plane upon which the individual is lying.

Figure 3:
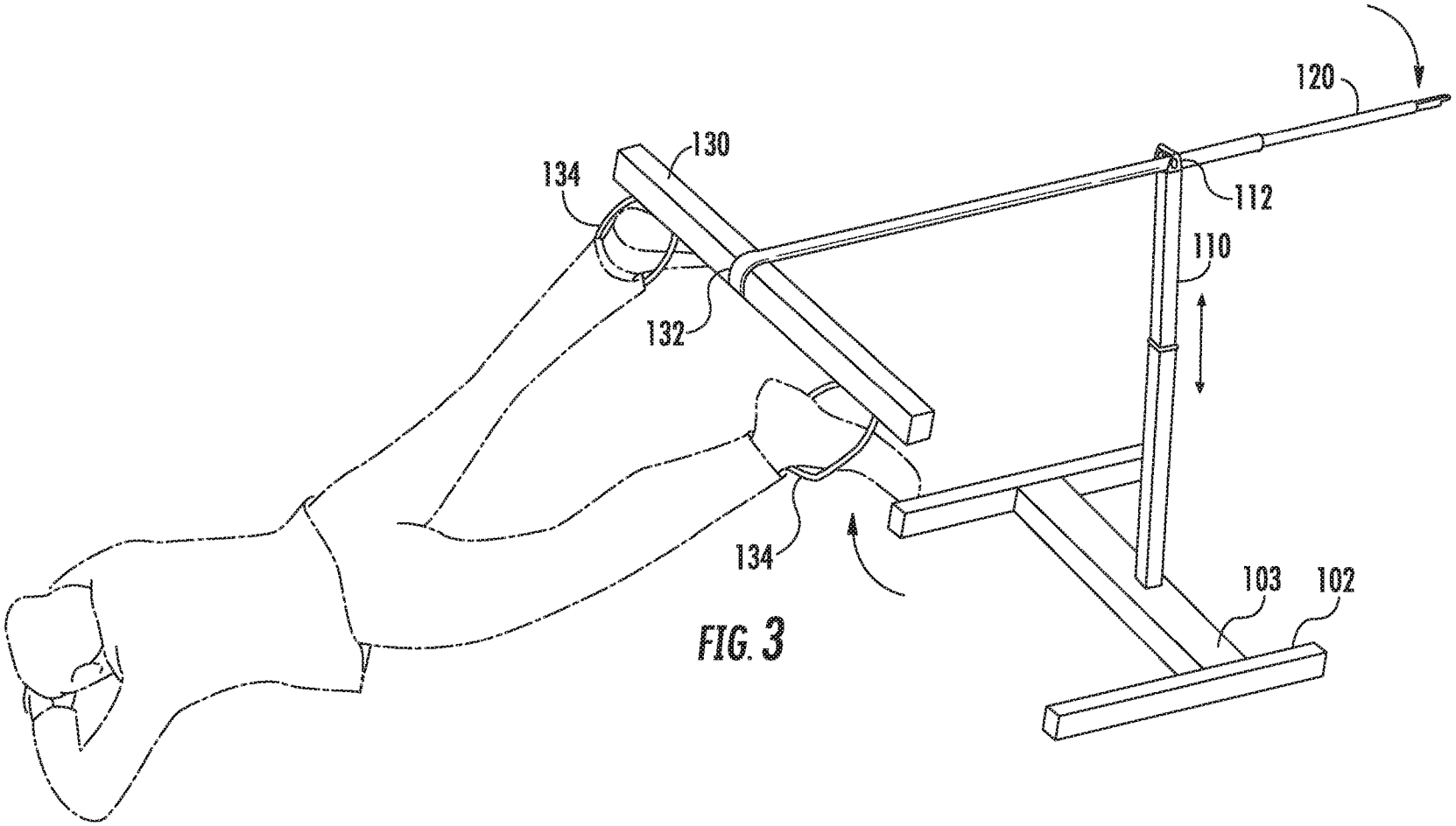
FIG. 3 is a side view of a person stretching at least one anterior muscle or ligament with device embodiments disclosed herein.

In this way, the individual is placed in a position that facilitates stretching of the anterior muscles and ligaments. FIG. 3 depicts such a stretch. In this stretch, it is desirable to raise the individual's feet off of the ground by at least 3 inches. The elevation height of the individual's feet can vary from 3 inches to over 40 inches depending on the individual's proportions and flexibility. In preferred methods of use, the individual's upper chest, arms, and head remain on the surface upon which the device 100 is located.

It may be desirable to rotate the rotational lift lever 120 circumferentially 124 about a vertical pivot member 112 so as to provide a stretch that varies on alternate sides of the anterior muscles. For example, some individuals may be tighter on the left side of their interior muscles.

Similarly, the lower extremity elevation member 130 could also be rotated circumferentially about the lower extremity pivot member 132. This type of rotation could increase the height of one foot with respect to another, as shown along axis 136. In this embodiment, device 100 and methods of use thereof can create a bias to stretch one anterior quadrant preferentially over the other. This is accomplished by lifting one leg higher or lower than the other. Using the rotational aspects of these embodiments could address disparities in muscle, fascia, or ligament tightness.

In these embodiments, the vertical pivot member 112 and the lower extremity pivot member 132 could be a ball and socket, U-joint, a locking joint, or similar pivot means known to those of skill in the art.

In operation, the vertical member 120 could be lowered so that at least one extremity of a human body is lifted off of the ground by another human, for example a physical therapist, exercise coach, spouse, and so forth. In alternate embodiments, this step could be accomplished automatically via an automated system, for example, a hydraulic lift, which could be activated by the individual seeking the stretching benefits of the device 100.

In some embodiments configured for use with individuals who may have damaged or lost a lower extremity, there could be a means of compensating for the physics of lifting the individual into a stretching position. For example, one of the lower extremity attachment devices 134 could be configured to accept an additional weight to offset the imbalance created by the individual's asymmetry.

Those of skill in the art will recognize throughout this specification that when like terms are used to describe features and functionalities of various portions of a particular embodiment, those same features and functionalities could be present in additional embodiments having aspects with like terms.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The terms "coupled to" or "connected to" are intended to mean both a direct coupling or connection as well as a coupling or connection where there are one or more intermediary elements, devices, parts, and the like.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. A method of stretching at least one anterior muscle in a human body using a device having a base frame having a front end and a rear end; a vertical member secured to the base frame; a rotational lift lever secured to the vertical member at a vertical pivot member, the rotational lift lever being vertically pivotal about the vertical pivot member; a lower extremity elevation member secured to the rotational lift lever; and at least one lower extremity attachment device secured to the lower extremity elevation member, the method comprising:

positioning a human body in a face-down, prone position on a flat plane in proximity to the device;

inserting at least one lower extremity of the human body into the at least one lower extremity attachment device; and raising the vertical member so that the at least one extremity of the human body is lifted at least three (3) inches off of the flat plane.

2. The method of claim 1 further comprising adjusting a transverse location of the vertical member with respect to the base frame.

3. The method of claim 1 further comprising rotating the rotational lift lever about the vertical pivot member.

4. The method of claim 1 further comprising rotating the lower extremity elevation member about a lower extremity pivot member.

* * * * *